US006561365B2

(12) United States Patent
Bustos

(10) Patent No.: US 6,561,365 B2
(45) Date of Patent: May 13, 2003

(54) PRODUCT DISPLAY AND DISPENSING SYSTEM

(75) Inventor: Rafael T. Bustos, Atlanta, GA (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 09/989,220

(22) Filed: Nov. 20, 2001

(65) Prior Publication Data

US 2002/0060198 A1 May 23, 2002

Related U.S. Application Data

(60) Provisional application No. 60/252,310, filed on Nov. 21, 2000.

(51) Int. Cl.[7] ..... A47F 57/00
(52) U.S. Cl. ..... 211/187
(58) Field of Search ..... 211/187, 186, 211/59.2; 108/108

(56) References Cited

U.S. PATENT DOCUMENTS

| | | | | | |
|---|---|---|---|---|---|
| 580,383 | A | * | 4/1897 | Duffee | 211/199 |
| 1,770,755 | A | * | 7/1930 | Kleinpell | 160/135 |
| 3,434,249 | A | | 3/1969 | Richey | |
| 3,626,870 | A | * | 12/1971 | Schild | 108/108 |
| 3,730,108 | A | * | 5/1973 | Stroh | 108/108 |
| 4,479,583 | A | | 10/1984 | Franklin | |
| 4,523,722 | A | | 6/1985 | Cohen | |
| 4,790,707 | A | | 12/1988 | Magretta | |
| 4,919,282 | A | | 4/1990 | Duff | |
| 5,013,100 | A | | 5/1991 | Zich | |
| 5,205,421 | A | | 4/1993 | Bustos | |
| 5,257,701 | A | * | 11/1993 | Edelson | 108/116 |
| 5,379,905 | A | | 1/1995 | Bustos | |
| 5,593,048 | A | * | 1/1997 | Johnson | 211/184 |
| 5,607,068 | A | | 3/1997 | Coretti, Jr. | |
| 5,611,442 | A | | 3/1997 | Howard | |
| 5,738,230 | A | * | 4/1998 | Goldstein | 211/149 |
| 5,860,714 | A | | 1/1999 | Skord, Jr. | |
| 5,871,108 | A | | 2/1999 | White | |

OTHER PUBLICATIONS

Pull and pivot back–loading system (Exhibit A).
Pivoting gondolas (Exhibit B).

* cited by examiner

*Primary Examiner*—Alvin Chin-Shue
*Assistant Examiner*—Sarah Purol
(74) *Attorney, Agent, or Firm*—Michael Best & Friedrich, LLC

(57) ABSTRACT

The present invention provides a shelving system comprising a gondola display having two rows of rear-loading shelves arranged back-to back. In one row of shelves, the shelves are hingedly attached to the gondola display, thereby allowing the shelves to be rotated away from the gondola. This exposes both the rear of the rotated shelves and the rear of the shelves located directly behind the rotated shelves, thereby allowing for easy rear-loading of product into both row of shelves at the same time. The present invention can also be used to allow for easy rear-loading of conventional gondola displays having a fixed base or bases. In such instances, a row of rotating shelf units, each having a retractable support wheel, is attached to one side of the conventional gondola. When these units are in their display position and when first rotated away from the gondola, the wheel is in a retracted position so that it is in contact with and can be rolled along the top surface of the fixed base. As the unit is rotated away from the gondola display and into its loading position, the wheel will extend downwardly from the bottom of the unit so that the wheel contacts and moves along the ground surface. In this manner, the retractable wheel is always available to provide support for, and facilitate the rotating movement of, the rotating shelf unit.

43 Claims, 16 Drawing Sheets

PRODUCT DISPLAY AND DISPENSING SYSTEM

This application is based on and claims priority from U.S. Provisional Application Ser. No. 60/252,310, filed Nov. 21, 2000.

FIELD OF THE INVENTION

This invention relates to a shelving system for displaying and dispensing products for sale in a self-service retail environment. It is particularly adapted for facilitating the rear-loading of such shelving systems.

BACKGROUND OF THE INVENTION

Rotating retail store inventory on a first-in, first-out basis is always desirable, and is especially important in the case of perishable foodstuffs. Rear loading of product onto retail store shelves is one way of achieving this goal: consumers withdraw product from the front, and delivery personnel re-stock from the rear.

Large grocery stores must stock a wide range of items to attract a diverse customer base. Unfortunately, not all of the items that a store stocks in order to maintain customer loyalty sell at the same turnover rate. Some items are slow-selling compared to others, but still must be stocked in order to attract a broad spectrum of repeat customers to the store.

Rear loading makes it easier to stock and display such slower-selling items. Although it is desirable to carry less inventory of slower-selling items, a retailer stocking a front-loading shelf with such items usually fills the entire depth of the shelf in order to achieve a uniform appearance and an aligned front row of products. Accordingly, the retailer has to order and stock more inventory of these items than necessary, which, when considered in the context of the entire store, can be unnecessarily expensive. In contrast, rear loading makes it easier to stock and display just a few of the slow-selling items while still achieving a uniform and attractive front product row. This allows the retailer to order and stock a reduced inventory of such slow-selling items, resulting in significant savings. Also, with a rear-loading rack, it is possible to place a mark on the shelves indicating for stocking personnel the desired amount of inventory to be stocked on the shelves, so that the inventory can be carefully monitored and controlled.

Despite these and other advantages of rear loading, prior art display and dispensing shelves suffer from several drawbacks that make rear loading difficult or impossible. In some prior art systems, access to the shelves is available only from the front. (See U.S. Pat. No. 4,919,282 issued to Duff, and U.S. Pat. No. 5,611,442 issued to Howard.) Such systems do not facilitate first-in, first-out inventory rotation, because when inventory is replenished it is difficult to load newer product onto the shelves behind previously loaded older product.

Other systems enable rear-loading, but suffer from drawbacks that make such loading difficult, inefficient or impracticable. In some instances, the system can only be used under certain conditions. For example, U.S. Pat. No. 5,593,048 issued to Johnson provides a hinged rear wall for rear access to the shelves for re-stocking. But this arrangement requires a working area behind the shelf rack into which the rear wall can swing, a re-stocking clerk can stand, and trays or boxes of product to be shelved can be temporarily stored during the re-stocking process. Because a working area is required behind the shelving system, the shelving racks cannot be placed in a back-to-back configuration, which complicates the problem of store layout.

In other instance, it is difficult to maneuver the system in and out of the loading position. For example, U.S. Pat. No. 5,607,068, issued to Coretti, discloses racks having open rears and wheels permitting the racks to be moved for access to the open rear. Coretti's rolling racks, however, do not provide a means for orderly movement of the racks for loading, or for subsequent re-alignment of the racks to form a uniform facade. Such re-alignment is considered critical to the aesthetic appearance of a retail store, and the all-important factor of consumer acceptance. Moreover, it is also important to provide for the orderly movement of the racks to facilitate quick and easy restocking by delivery personnel. When racks do not provide for such orderly movement, restocking can become cumbersome and time consuming, thereby defeating the purpose of providing a rear-loading rack.

It is therefore one object of the invention to provide a product display and dispensing system which enables rear-loading of product onto the shelves of the system to facilitate the desired first-in, first-out inventory rotation.

Another object of the invention is to provide a display system comprising a plurality of individual shelf racks that can be efficiently and easily rear-loaded.

A further objective of the present invention is to provide a display system comprising back-to-back rows of shelving that can be efficiently and easily rear-loaded.

An additional object is to facilitate the orderly movement and replacement of shelf racks when a plurality of racks of shelves are located adjacent to one another, so that the racks can be easily rear-loaded.

Another objective is to provide a display system comprising a plurality of individual racks where the racks can be easily positioned to form an attractive, uniform facade for displaying product.

Yet another objective is to provide a display system that can be installed on standard conventional gondola systems to achieve easy rear-loading.

SUMMARY OF THE INVENTION

These and other objects are achieved by a shelving system comprising a gondola display having two rows of rear-loading shelves arranged back-to-back. In one row of shelves, the shelves are hingedly attached to the gondola display, thereby allowing the shelves to be rotated away from the gondola. This exposes both the rear of the rotated shelves and the rear of the shelves located directly behind the rotated shelves, thereby allowing for easy rear-loading of product into both row of shelves at the same time.

Because the row of rotating shelves are hingedly attached to the gondola display, they can be placed back into their original display position within the row merely by rotating the shelves back in place—there is no need to realign the shelves after rear-loading them. Likewise, there is no need to realign the non-rotating row of shelves because they can be rear-loaded in their original display position.

The present invention can also be used to allow for easy rear-loading of conventional gondola displays having a fixed base or bases. In such instances, a row of rotating shelf units, each having a retractable support wheel, is attached to one side of the conventional gondola. When these units are in their display position and when first rotated away from the gondola, the wheel is in a retracted position so that it is in contact with and can be rolled along the top surface of the fixed base. As the unit is rotated away from the gondola display and into its loading position, the wheel will extend downwardly from the bottom of the unit so that the wheel contacts and moves along the ground surface. In this manner, the retractable wheel is always available to provide support for, and facilitate the rotating movement of, the rotating shelf unit.

In the preferred embodiment, the center panel of a conventional gondola is removed when the row of rotating shelf units is installed on the conventional gondola system. With this modification, rotating a shelf unit into its loading position also exposes the rear of the shelves located directly behind the rotating shelf, thereby allowing for easy rear-loading of both rows of shelves at the same time.

DETAILED DESCRIPTION OF THE INVENTION

Figure 1:
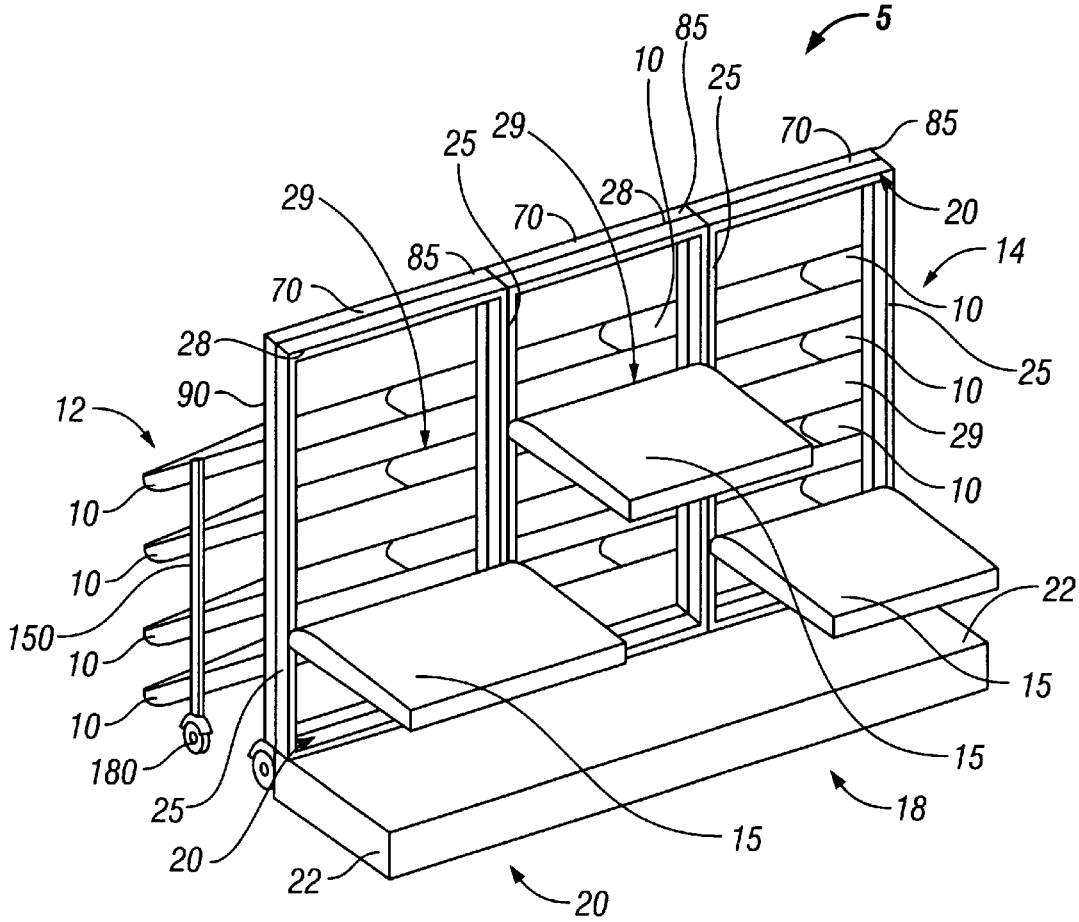
FIG. 1 is a perspective view of one embodiment of the present invention.
Figure 2:
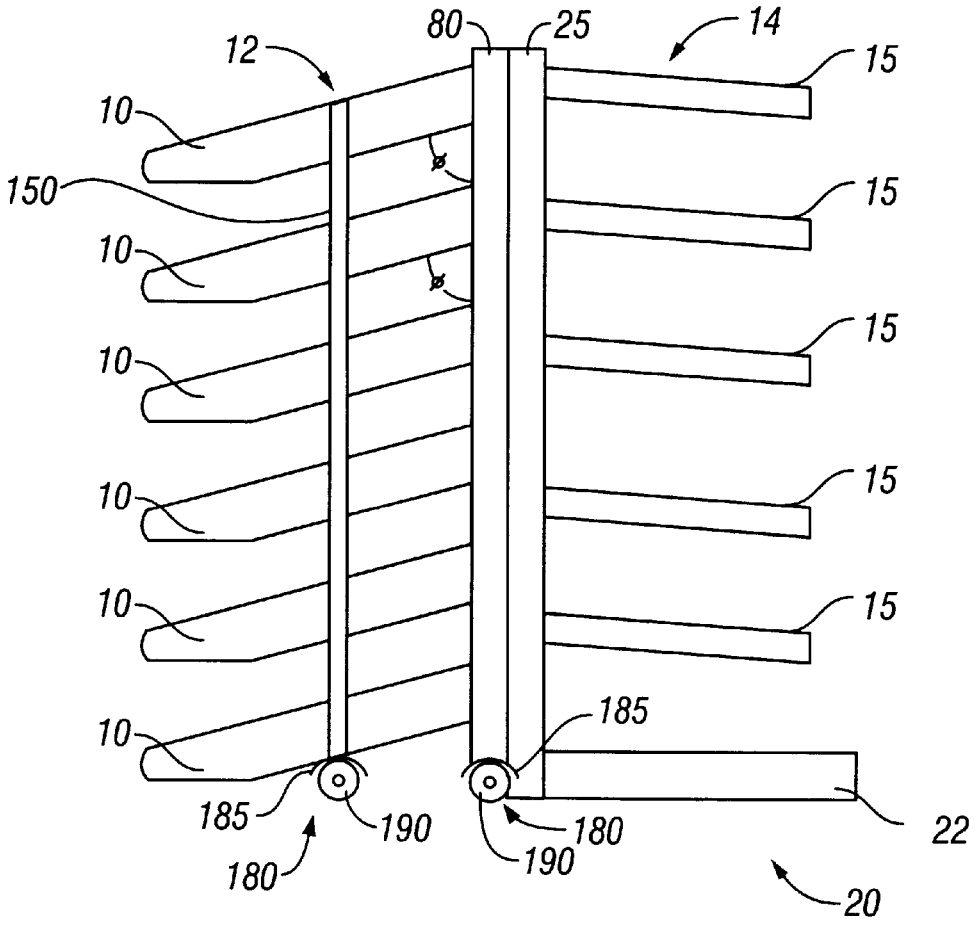
FIG. 2 is a side elevation view of the embodiment of FIG. 1.

FIGS. 1 and 2 illustrate a retail product display and dispensing system in accordance with one embodiment of the present invention. FIGS. 1 and 2 show a shelving system 5 comprising a row of rotating shelves 10 positioned back-to-back with a row of stationary shelves 15. In an alternative embodiment, both rows of shelves can comprise rotating shelves 10.

Shelves 10 and 15 are preferably attached to a support structure 18. In the embodiment shown in FIGS. 1 and 2, the shelves are attached to a gondola 20—an island fixture well known in the art and often used in stores to display merchandise—comprising a base 22 and a number of vertical supports 25 and horizontal supports 28. The spaces 29 between the base and the vertical and horizontal supports are left substantially open because, unlike with most prior-art gondola displays, there are no dividing panels separating the back-to-back display racks. That is, there are no panels or similar structural members separating the row of racks facing outward from one side of the gondola from the row of racks facing outward from the other side of the gondola. The open nature of the support structure is important because, as explained below, it helps provides access for rear-loading of the stationary shelves 15. (It is to be understood that gondola 20 is shown for illustrative purposes only and is not meant to limit the scope of the invention in any way. Any type of support structure can be used, such as free-standing standards or the back of another group of shelves.)

Figure 3:
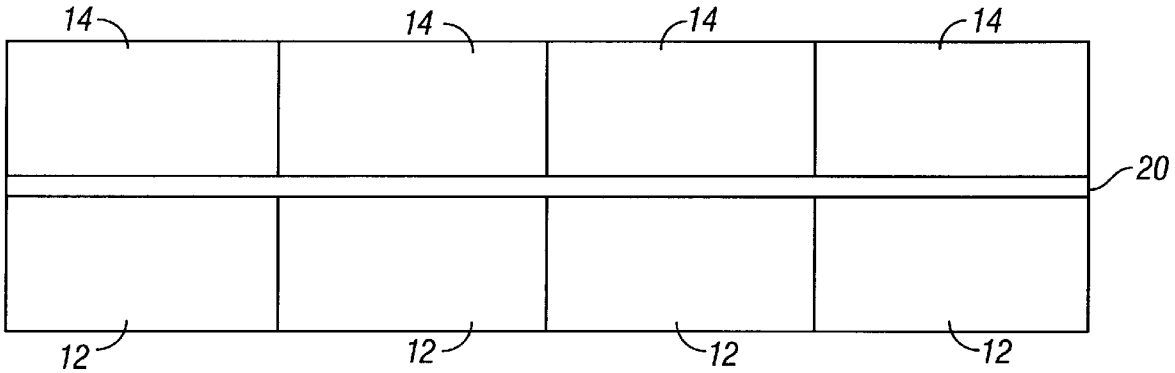
FIG. 3 is a schematic representation of an embodiment of the present invention showing the shelves in their display positions.
Figure 4:
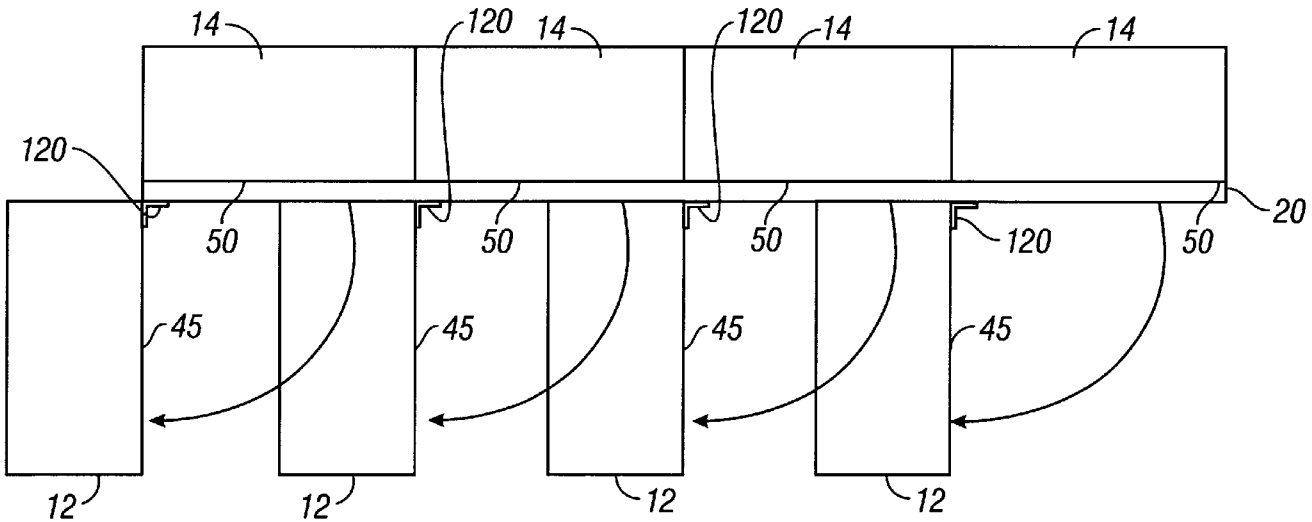
FIG. 4 is a schematic representation of an embodiment of the present invention showing the rotating shelves in their loading positions.

The rotating shelves 10 are rotationally attached to the gondola 20 such that the shelves can be rotated from their normal display position into a loading position. FIG. 3 is a schematic showing a row of rotating shelf units 12 and a row of stationary shelf units 14—each unit comprising one or more vertically spaced shelves—in the display position, wherein the units are precisely aligned to present a uniform, outwardly facing facade for displaying and selling product. FIG. 4 shows the rotating shelf units 12 in the loading position, after they have been rotated away from the gondola 20 in the direction of arrows 40.

When a rotating shelf 10 has been rotated into the loading position, rear 45 of the shelf is exposed, thereby allowing the shelf to be easily rear-loaded. And because of the open nature of the gondola support structure (i.e., the lack of panels dividing one row of shelves from the other row of shelves), moving shelves 10 into their loading position also exposes rear 50 of the stationary shelves 15 directly behind the corresponding rotating shelves 10. Accordingly, moving shelves 10 into their loading position allows for easy rear-loading of the corresponding stationary shelves located directly behind the rotated shelves.

In an alternative embodiment, both rows of shelves comprise rotating shelves. This configuration allows either row of shelves to be rear-loaded independently from the other row of shelves.

Because the row of rotating shelves are rotationally attached to the gondola display, they can be placed back into their original display position within the row merely by moving the shelves back in place—there is no need to realign the shelves after rear-loading them. Likewise, there is no need to realign the non-rotating row of shelves because they can be rear-loaded in their original display position.

Figure 5:
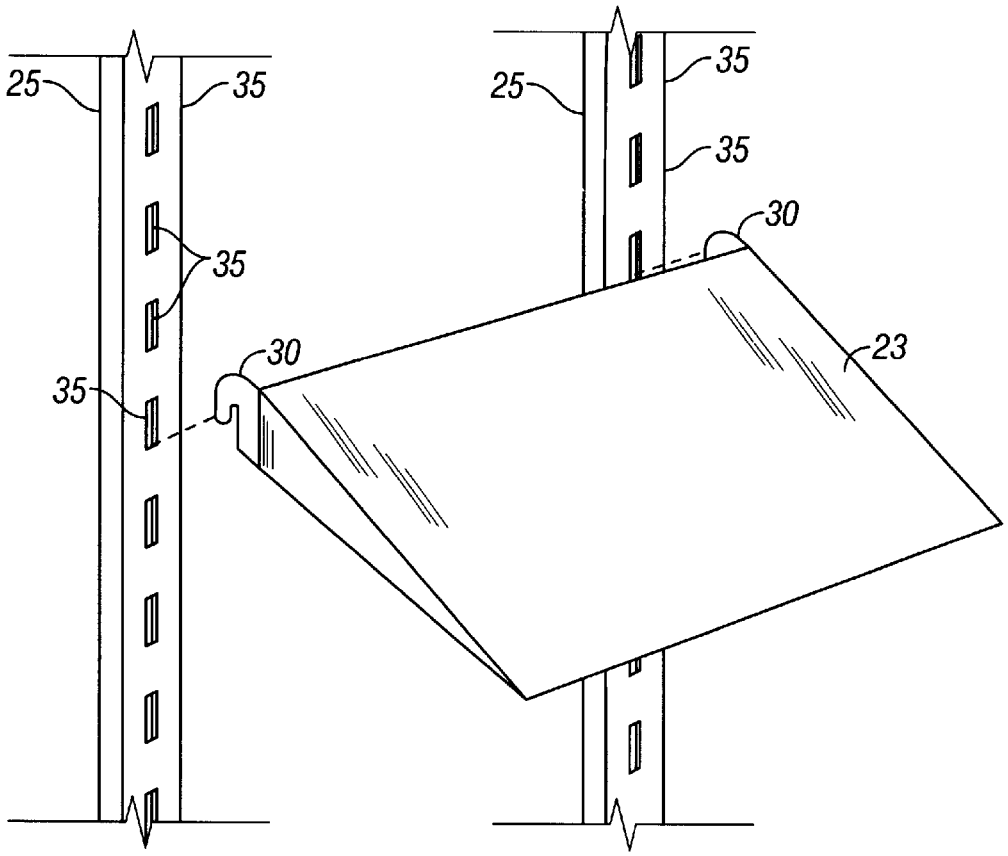
FIG. 5 is an exploded detail of a shelf and two vertical supports of the embodiment of FIG. 1.
Figure 6:
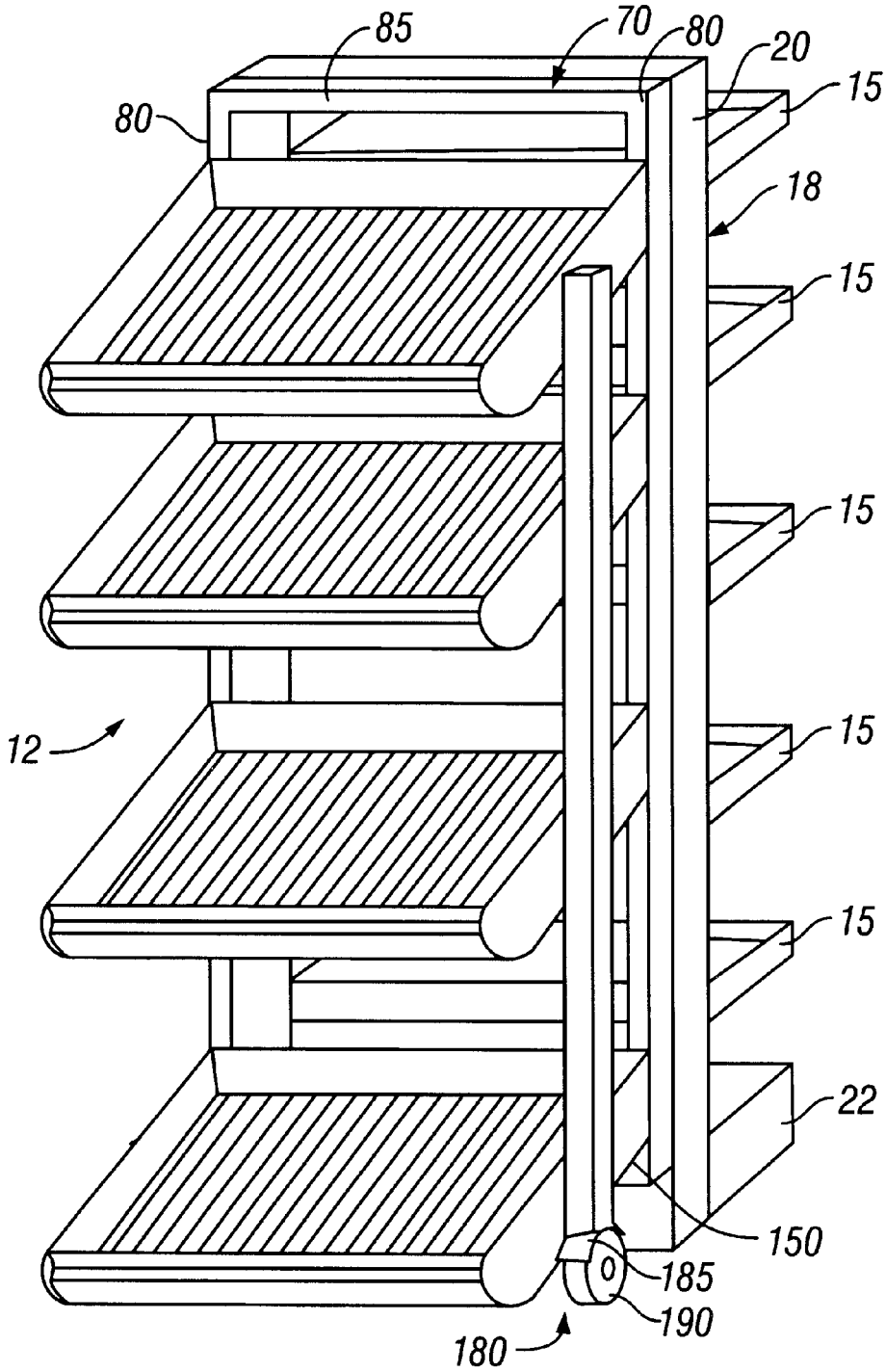
FIG. 6 is a front perspective view of a rotating shelf unit in the display position, i.e., back-to-back with a stationary shelf unit.

In the embodiment shown in FIGS. 1 and 2, stationary shelves 15 are attached to the gondola 20 by conventional means. In the embodiment shown in FIG. 5, shelves 15 are attached to gondola 20 by brackets or hook-like members 30, which are shaped and sized to fit within and engage apertures or slots 35 in gondola vertical supports 25. However, any suitable attachment means may be used, including, for example, spot welding, pegs or bolts.

As depicted in FIGS. 1 and 2, the shelves 15 may be inclined downwardly from the back to front to cause the displayed product to slide forward towards the front of the shelf. Of course, shelves 15 may also be attached to gondola 20 so that they are level with the horizontal. Regardless of how the shelves 15 are oriented, and as is customary in the art, the heights and spacing between the shelves can be adjusted by selectively mounting the shelves at the desired mounting slots 35.

Shelves 15 can be made in any suitable manner and from any suitable material. Each shelf 15 may be preferably constructed as a rack formed by a grid of wires such as metal wires, plastic wires, plastic coated metal wires (i.e. vinyl-coated), or any other suitable material. Alternatively, shelves 10 could be constructed from sheet material made of plastic, metal, composite materials, heavy cardboard, etc.

Rotating shelves 10 can be rotatably attached to the support structure 18 by any suitable means. For example, shelves 10 can be directly or indirectly attached to the support structure, either individually or as a group, by one or more hinges. In the preferred embodiment, shelves 10 are affixed to one or more shelf frames 70 that are hingedly attached to support structure 18. In the embodiment shown in FIGS. 1, 2, 6, and 7, shelf frame 70 comprises vertical standards 80, which are interconnected by horizontal beams 85.

Like shelves 15, each shelf 10 may be preferably constructed as a rack formed by a grid of wires such as metal wires, plastic wires, plastic coated metal wires (i.e. vinyl-coated), or any other suitable material. Alternatively, shelves 10 could be constructed from sheet material made of plastic, metal, composite materials, heavy cardboard, etc.

Shelves 10 are attached to frame 70 by any suitable means. In the embodiment shown in FIGS. 1, 2, 6, and 7, each shelf 10 removably mounts to vertical standards 80 and cantilevers outwardly and downwardly therefrom. In the illustrated embodiment of FIG. 8, vertical standards 80 have holes or slots 90 disposed along the length of their front surfaces for receiving rearwardly extending brackets 95 on the shelves. The heights and spacing of the shelves are adjusted by selecting the desired mounting holes or slots.

Preferably, the angle $\phi$ formed between the shelf 10 and the standards creates an incline sufficient to cause the displayed product to slide forward towards the front of the shelf 10. The selected angle $\phi$ depends in part on the product to be displayed and the materials comprising shelf 10.

Shelf frame 70 can be rotatably attached to the support structure 18 in any suitable manner, but is preferably attached to gondola vertical support 25 by hinge assembly 120. This allows the pivoting shelf rack 10 to be rotated about upright hinge assembly 120.

Figure 9:
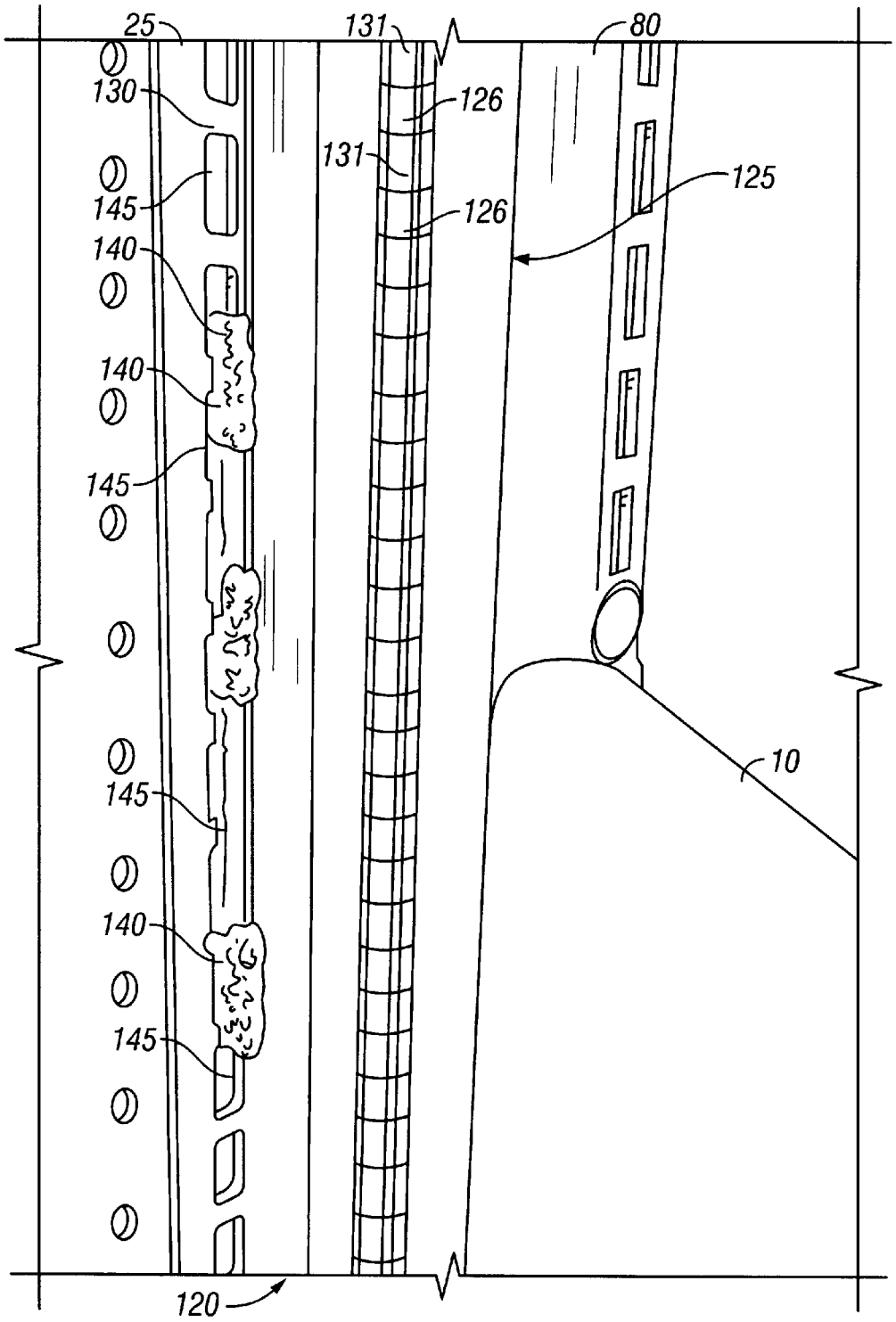
FIGS. 9 and 10 are perspective details of one embodiment of the hinge assembly.
Figure 10:
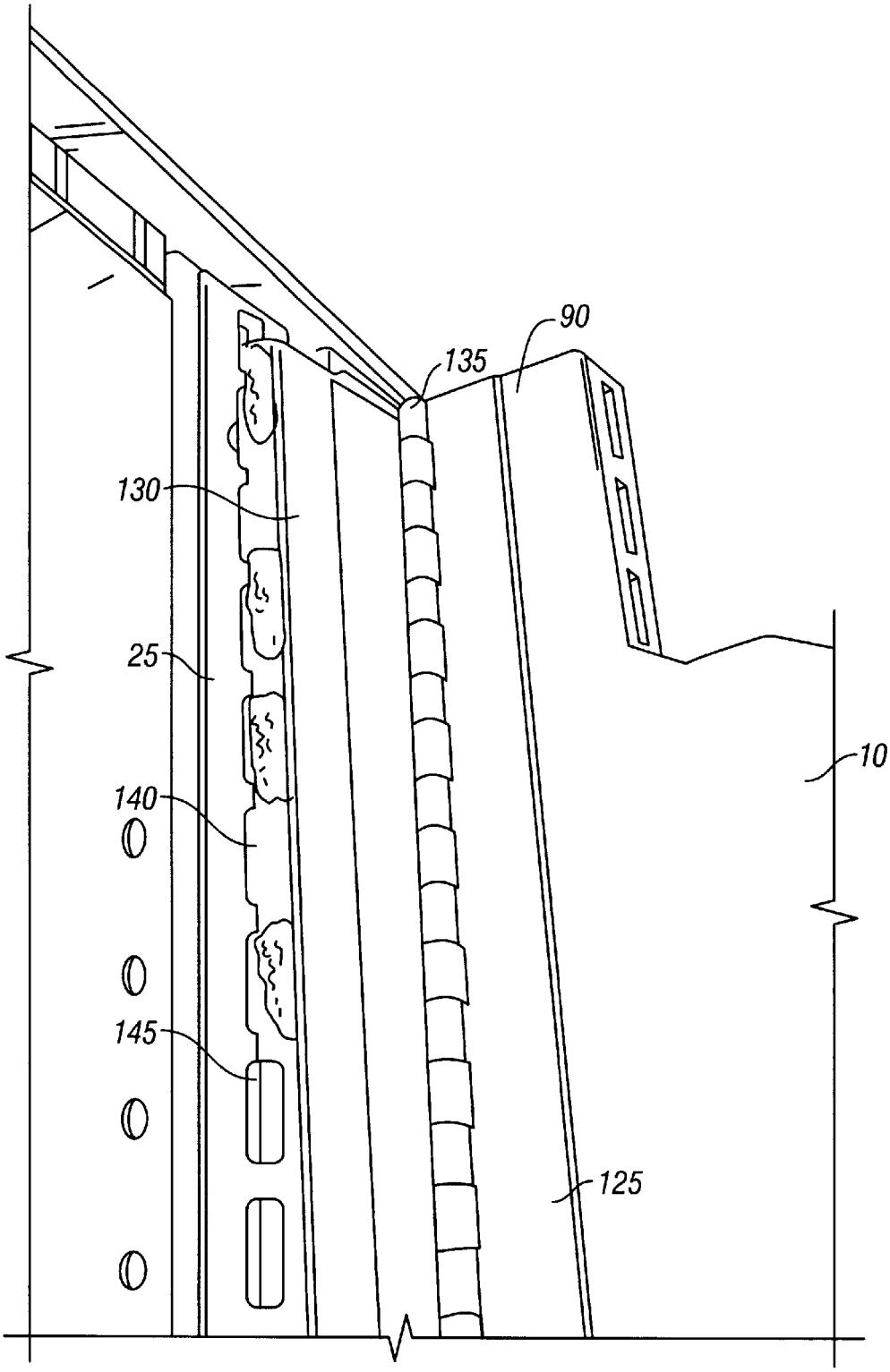

FIGS. 9–10 show the hinge assembly 120 and its components in detail. Hinge assembly 120 comprises a hinge plate 125 rotatably attached to hinge base 130 by pivot pin 135. The pin 135 extends through hinge sleeves 131 on hinge base 130 and hinge sleeves 126 on plate 125 to rotatably secure the plate 125 to base 130 and thereby form the hinge structure.

The hinge base 130 is affixed to gondola vertical support 25 by any suitable means. In the embodiment shown in FIGS. 9–10, the hinge base is removably attached to vertical support 25 by protrusions 140 located along the length of hinge base 130, which are shaped and sized to fit within and engage apertures or slots 145 in gondola vertical support 25. Any suitable alternative means can be used, however; for example, the hinge base 135 can be spot welded to vertical upright 25. Likewise, hinge plate 125 can be attached to frame 70 by any suitable means. In the preferred embodiment shown in FIGS. 9–10, hinge plate 125 is spot welded to vertical standard 80 of frame 70.

Preferably, hinge assembly 120 extends along at least a substantial length of vertical standard 80 and gondola vertical support 25. This arrangement prevents the load created by the weight of frame 70, shelves 10, and the merchandise stored thereon from being focused on just one point on the hinge assembly and thereby makes the hinge assembly more durable and able to support heavier loads.

In an alternate embodiment, a plurality of hinge assemblies can be spaced along the length of vertical standard 80 and gondola vertical support 25. For example, there can one hinge assembly attached near the top of the frame, one near the middle, and one near the bottom.

In the preferred embodiment, a vertical support member 150 runs between and connects the vertically spaced shelves 10 along their sides 155, which are furthest from the hinge assembly. Vertical member 150 serves at least two purposes. First, it forms a handle where the shelving assembly can be grasped in order to rotate the shelving outwardly from the product display position into the product loading position. Second, vertical support member 150 helps support shelves 10 and prevent them from sagging at sides 155.

Figure 7:
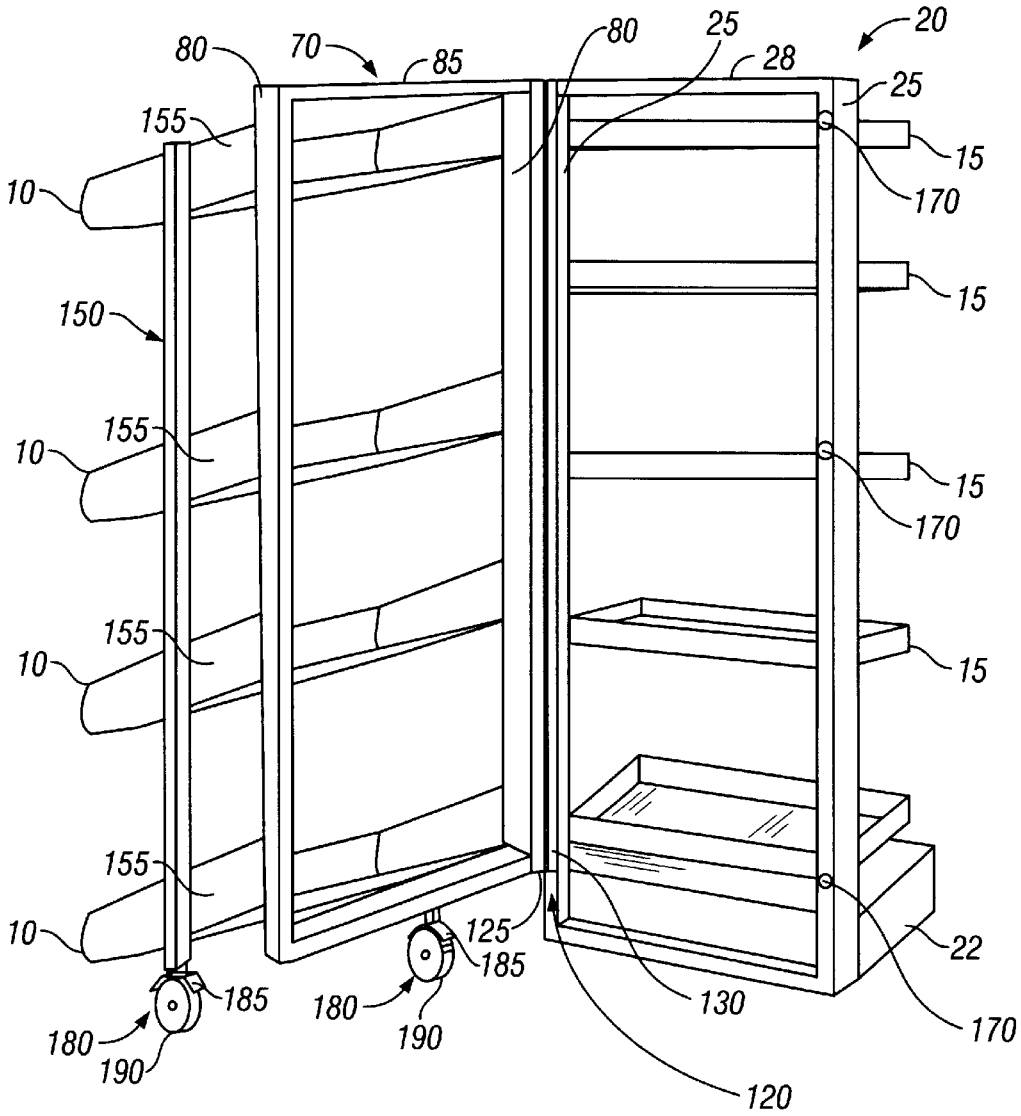
FIG. 7 is perspective view of the shelving of FIG. 6 with the rotating shelf unit in the loading position.
Figure 8:
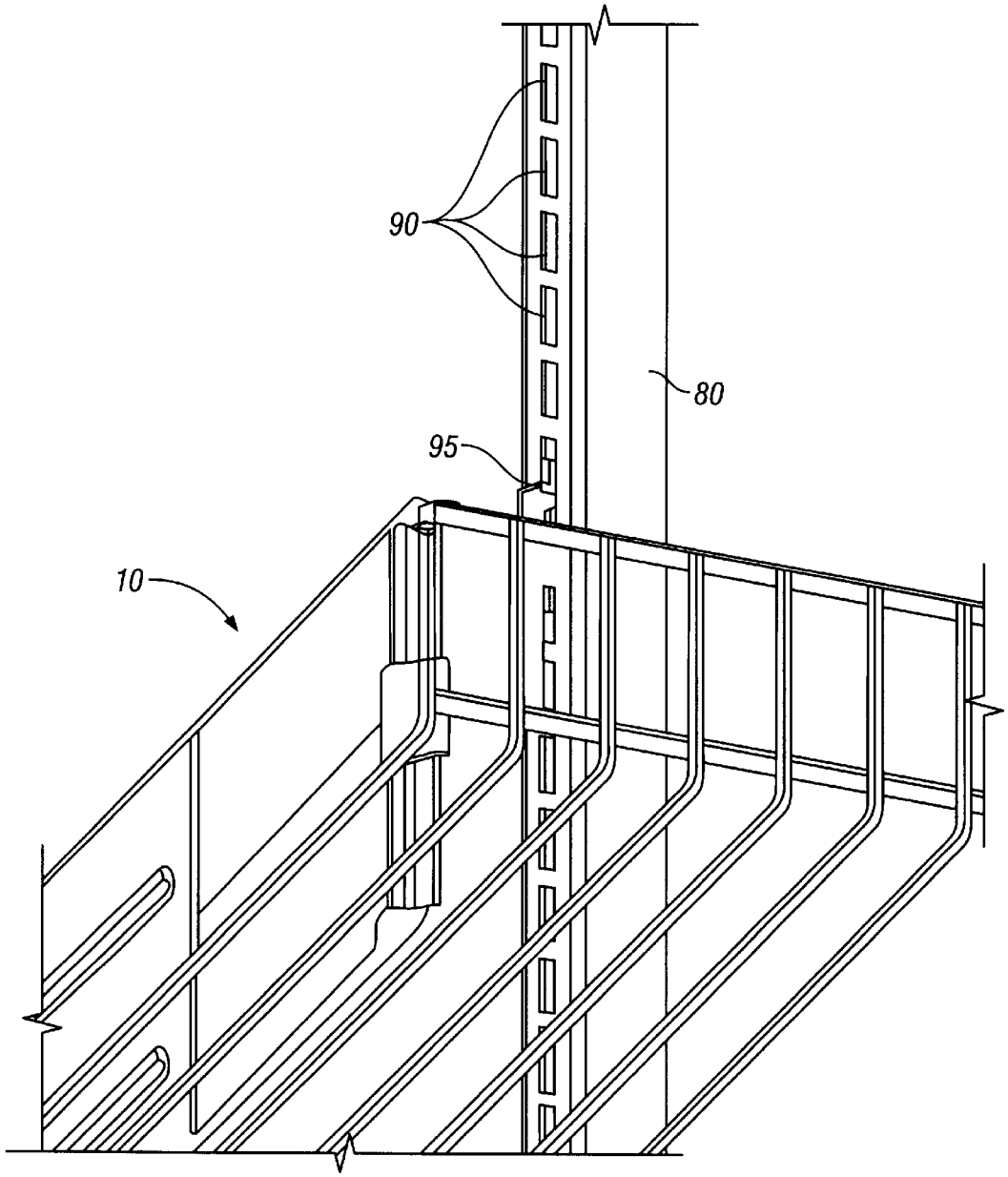
FIG. 8 is perspective detail of the rotating shelf of FIG. 6.

As shown in FIG. 7, a fastening device, such as a magnet 170, prevents shelves 10 from unintentionally rotating outward due to the unevenness of a store's floor or because the rack becomes unbalanced as it is emptied of product. In the preferred embodiment, one or more magnets 170 are located on the gondola vertical support 25 that is not attached to hinge assembly 120. Magnets 170 engage the metallic frame 70 to hold the frame in the product display position until the frame is deliberately rotated outward about the hinge assembly 120. In alternative embodiments of the present invention, other fastening devices, such as Velcro hook and loop fasteners or spring-loaded latches, may be employed to secure a rack to the rear assembly.

In one embodiment, casters 180, each comprising a bracket 185 and a wheel 190, are associated with rotating shelves 10. In the embodiment shown in FIGS. 1–2 and 6–7, casters 180 are mounted to vertical support member 150 and the bottommost horizontal beam 85 of frame 70. The casters 180 help support the load created by the weight of frame 70, shelves 10 and the merchandise stored thereon. They also facilitate easy rotating of the rack between the product display and loading positions.

Figure 11:
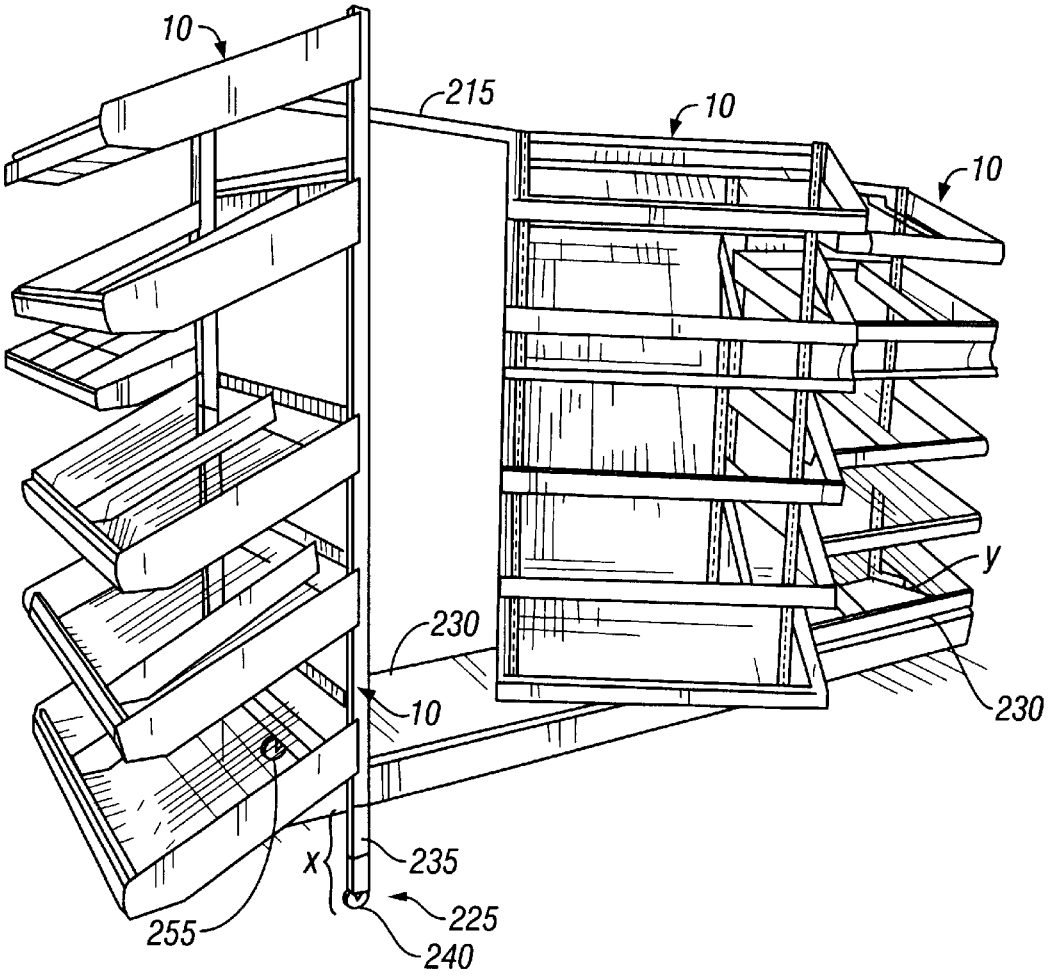
FIG. 11 is a perspective view of another embodiment of the present invention.
Figure 12:
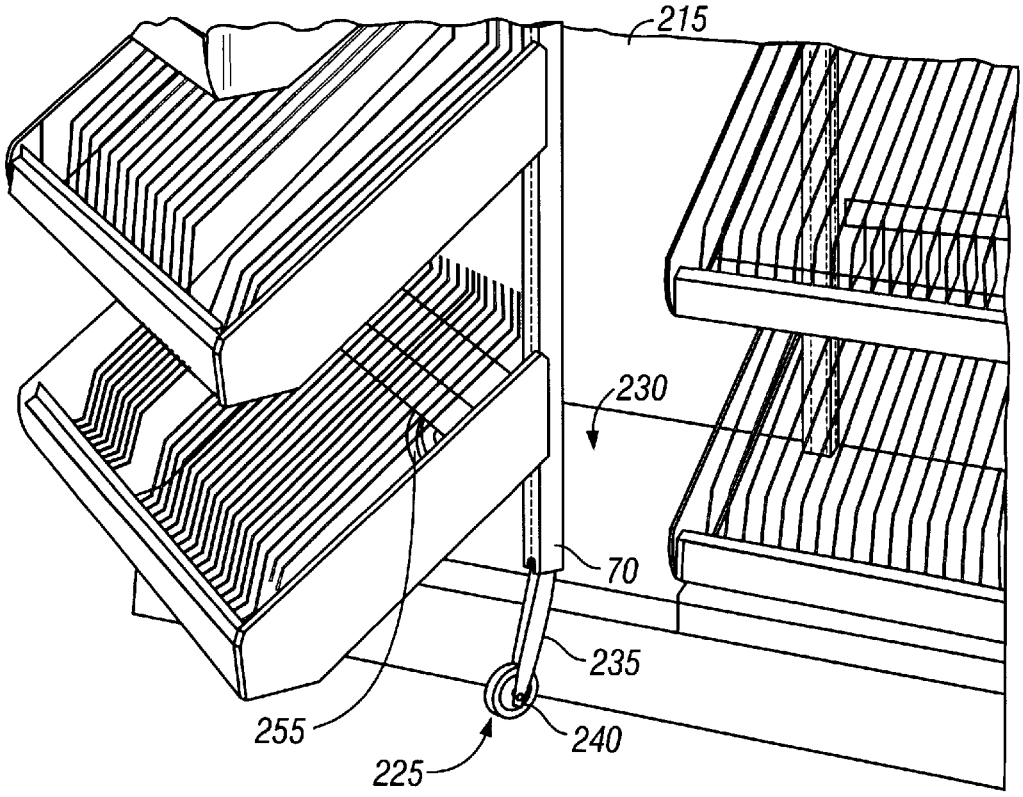
FIG. 12 is a perspective detail of the embodiment of FIG. 11.

In an alternative embodiment, the rotating shelves 10 are adapted to work with a preexisting support structure, such as gondola display 215 shown in FIGS. 11 and 12, having a base 220 located beneath the rotating shelves. In this embodiment, one row of one or more rotating shelf units is rotatably attached to one side of the conventional gondola as described above so that the unit can be easily rotated into its rear-loading position. In the preferred embodiment, shelves 10 are rotatably attached to the gondola by means of hinged frame 70 as described above.

In one embodiment, the row of shelves on the other side of the gondola are stationary shelves as described above. In an alternative embodiment, both back-to-back rows of shelves that face outwardly from each other are rotatably attached to the gondola.

In the preferred embodiment, the center panel of the conventional gondola is removed so that moving the rotating shelves 10 into their loading position also exposes the rear of the shelves located directly behind the rotating shelves.

This additional modification allows for easy rear-loading of both rows of shelves at the same time.

Because conventional gondolas feature a fixed base, at least one spring-biased, retractable wheel assembly 225 is associated with rotating shelves 10. In the embodiment shown in FIGS. 11–12, wheel assembly 225 comprises a leg 235 having a proximal end pivotally connected to frame 70. A wheel 240 is rotationally attached to the distal end of leg 235. As discussed below, spring mechanism 245 biases the wheel leg 235 towards it extended position x as shown in FIG. 11.

When shelves 10 and frame 70 are in the product display position, wheel assembly 225 is held in the retracted position y by the wheel's contact with the top surface 230 of base 220. As the frame 70 and the shelves attached thereto are first rotated away from the gondola 215, wheel 240 remains in contact with and moves along the top surface 230 of base 220. But when frame 70 is rotated further away and out from the gondola display 215, wheel 225 is no longer in contact with surface 230.

Once the wheel 225 loses contact with the surface 230, surface 230 does not act upon the wheel assembly 225 to keep it in the retracted position and spring mechanism 245 biases the wheel assembly 225 to pivot the wheel assembly into its extended position x, such that leg 235 fully extends from frame 70 and wheel 240 engages the ground surface 250. In this position, the retractable wheel assembly provides support for, and facilitates movement of, frame 70 and the shelves attached thereto as the frame is further rotated into the loading position.

After the shelves 10 have been loaded, they are rotated back into the display position. During the initial return rotation, wheel assembly 225 remains in the fully extended position x so that wheel 240 is in contact with ground surface 250 to both support frame 70 and facilitate its movement. But as the frame approaches the display position, leg 235 is brought into contact with base 220 as shown in FIG. 12. Continued rotation of the rack towards the display position forces the wheel assembly 225 to pivot back into its retracted position y, where it continues to support the rack as it moves over base 220 and is returned to the display position.

Figure 15:
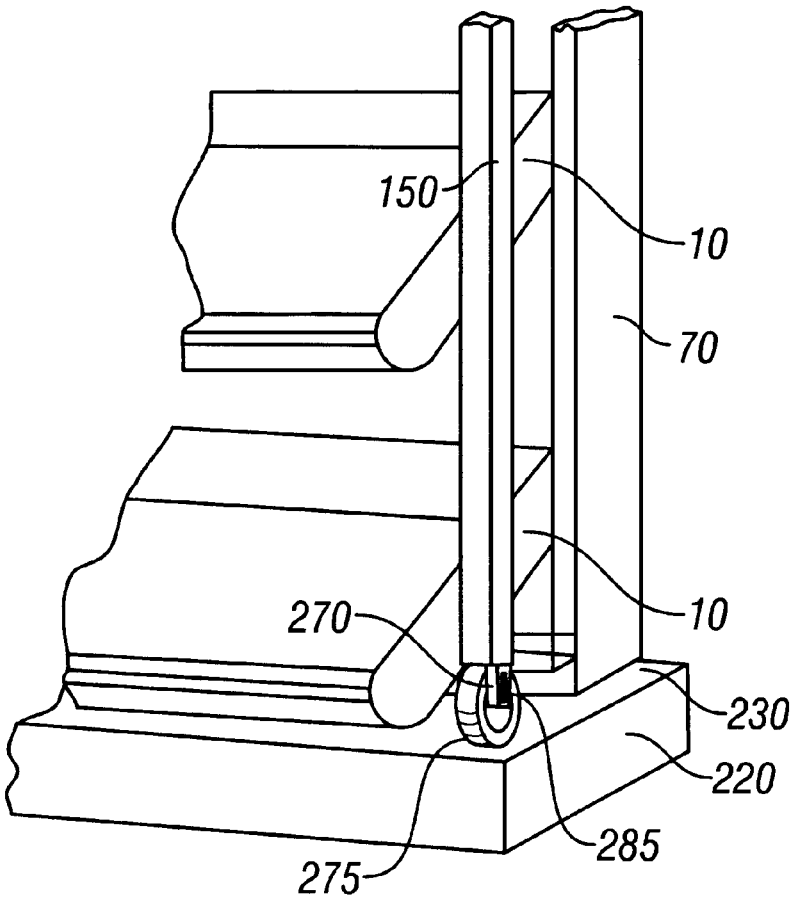
FIG. 15 is a perspective detail of another embodiment of a retractable wheel attached to a rotating shelf unit.
Figure 16:
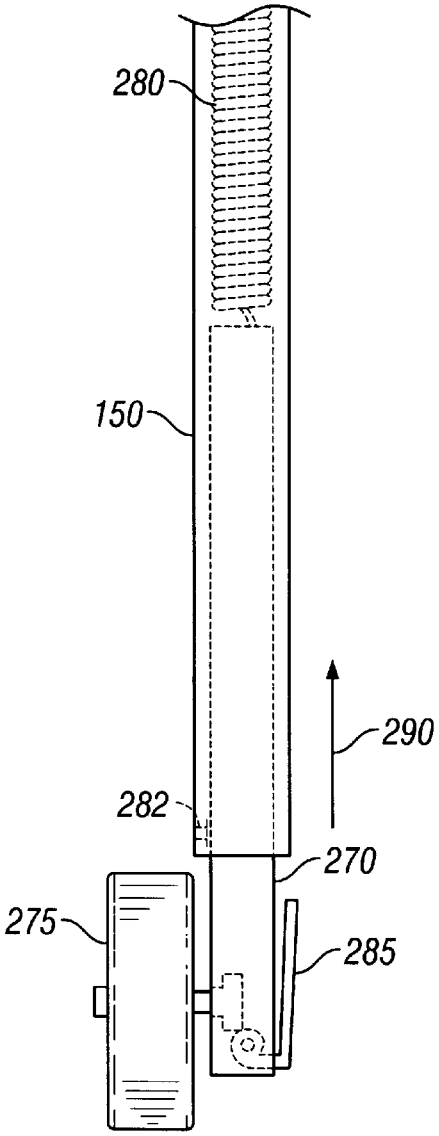
FIG. 16 is a front elevation view of the retractable wheel of FIG. 15 in its retracted position, with dotted lines showing the position of the spring, extension and lever.
Figure 17:
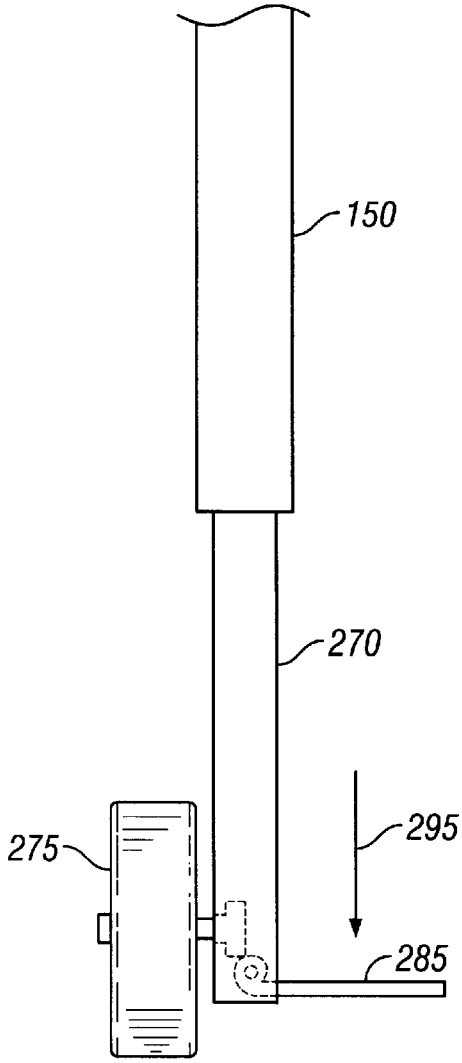
FIG. 17 is a front elevation view of the retractable wheel of FIG. 15 in its extended position.

In an alternative embodiment shown in FIGS. 15–17, retractable wheel assembly 225 comprises extension 270, wheel 275, extension spring 280, catch 282, and lever 285. In this embodiment, vertical support member 150 is hollow and extension 270 fits within support member 150 so that the extension can telescope in and out of support member 150. When the rotating shelving is in its display position, extension 270 is retracted within support member 150. In this position (shown in FIGS. 15 and 16), wheel 275 attached to extension 270 rests on top surface 230 of the base 220 and helps to support the weight of the frame 70, the shelves 10 attached to the frame, and any merchandise stored on the shelves.

Extension spring 280 is located within support member 150 (FIG. 16), with one end of spring 280 anchored within support member 150 and the other end of spring 280 affixed to the proximal end of extension 270 (the wheel 275 being located at the distal end of extension 270). Extension spring 280 exerts a force on extension 270 in the direction of arrow 290 (upward), thus holding the extension 270 in its retracted position unless a downward force is exerted on extension 270.

As the shelves 10 are rotated away from the base 220 and over the ground surface, a force is first applied to the lever 285 to pivot the lever downward into a horizontal position (FIG. 17) and then downward in the direction of arrow 295 (by, for example, stepping on lever 295) to force extension 270 into its extended position wherein wheel 275 rests on the ground surface. Catch 282 locks the extension 270 in its fully extended position, thus allowing wheel 275 to continue to bear the weight of the shelves as they are rotated into their loading position.

Once loading is completed, the shelves are rotated back towards the base and their display position. As the shelves approach the base, lever 285 is pivoted upward into its off position (for example, by using a foot to push up the lever), thereby releasing catch 282. When catch 282 is released, spring 220 once again acts on the extension 270 to pull it back upward into its retracted position to roll on surface 230 of base 220, where wheel 225 will support and assist the rotation of shelves 10 as they are returned to their loading position.

One or more additional wheels 255 may be attached to frame 70 as shown in FIGS. 11 and 12 to provide for additional support of the frame and the shelves 10 attached thereto. Wheels located closer to the hinge assembly (such as wheel 255 shown in FIGS. 11 and 12) will remain directly over the gondola base during the entire rotation of the rack and, therefore, need not be retractable. In addition, other retractable wheels can also be located further from the hinge assembly to provide additional support if necessary or desired.

Figure 13:
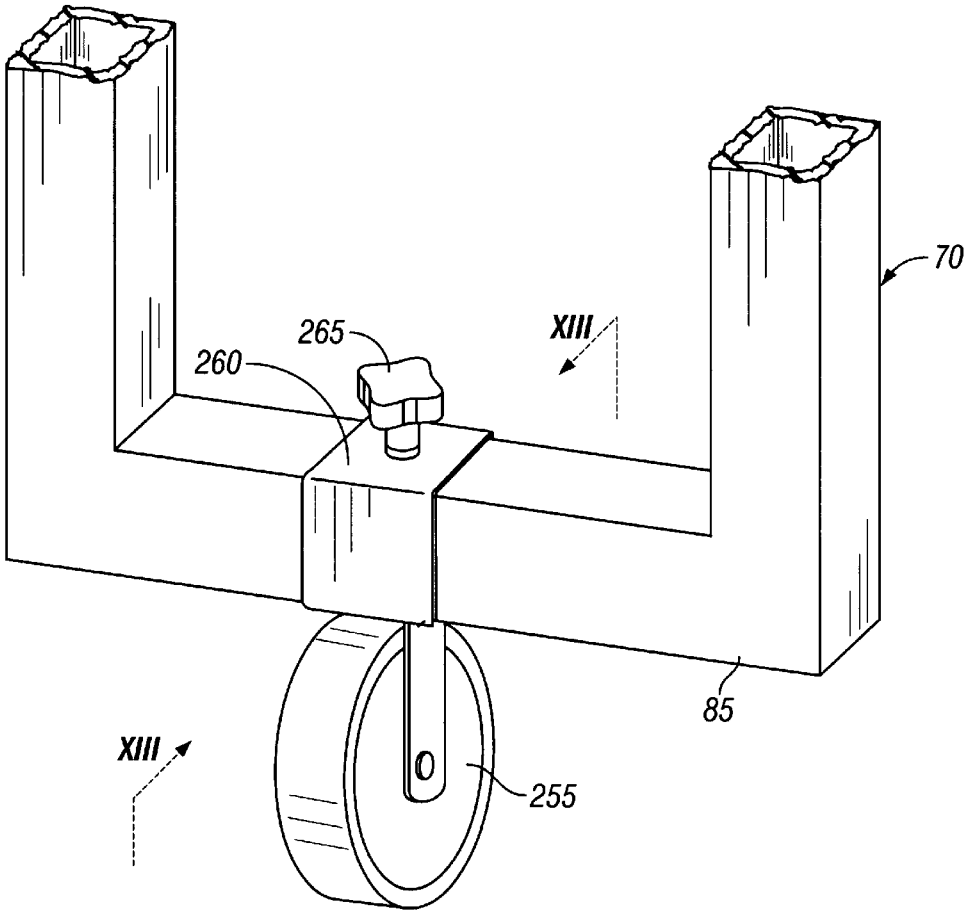
FIG. 13 is a perspective detail of a wheel adjustably connected to a shelf frame.
Figure 14:
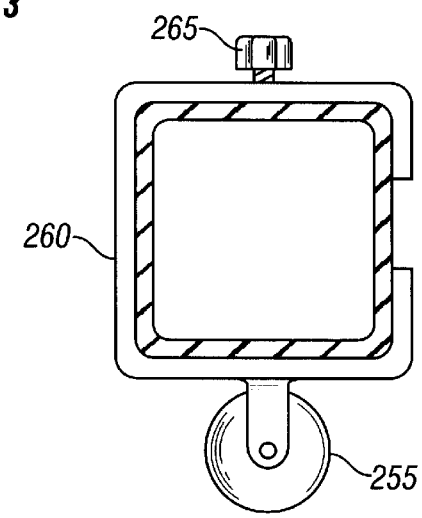
FIG. 14 is a cross-sectional side view of the embodiment of FIG. 13 taken along line XIII—XIII.

In the preferred embodiment, additional wheel 255 is adjustably attached to frame 70, thereby allowing the wheel to be used on gondola bases of different sizes. In the embodiment shown in FIGS. 13–14, additional wheel 255 is attached to frame 70 by means of a bracket 260 that fits around the bottom horizontal beam 85 of frame 70. Bracket 260 (and, therefore, wheel 255 attached thereto) can be slid along the length of beam 70 until it is in the desired location. It can then be secured in place by tightening screw 265 to engage the lower horizontal beam 85.

Because the wheel is slidingly adjustable, it can be moved closer to or further away from hinge assembly hinge assembly 120. It can thus be adjusted so that it always remains in contact with the base, regardless of the size of base 220—for narrower bases, the wheel can be placed closer to the hinge assembly; for wider bases, the wheel can be placed further away from the hinge assembly.

Figure 18:
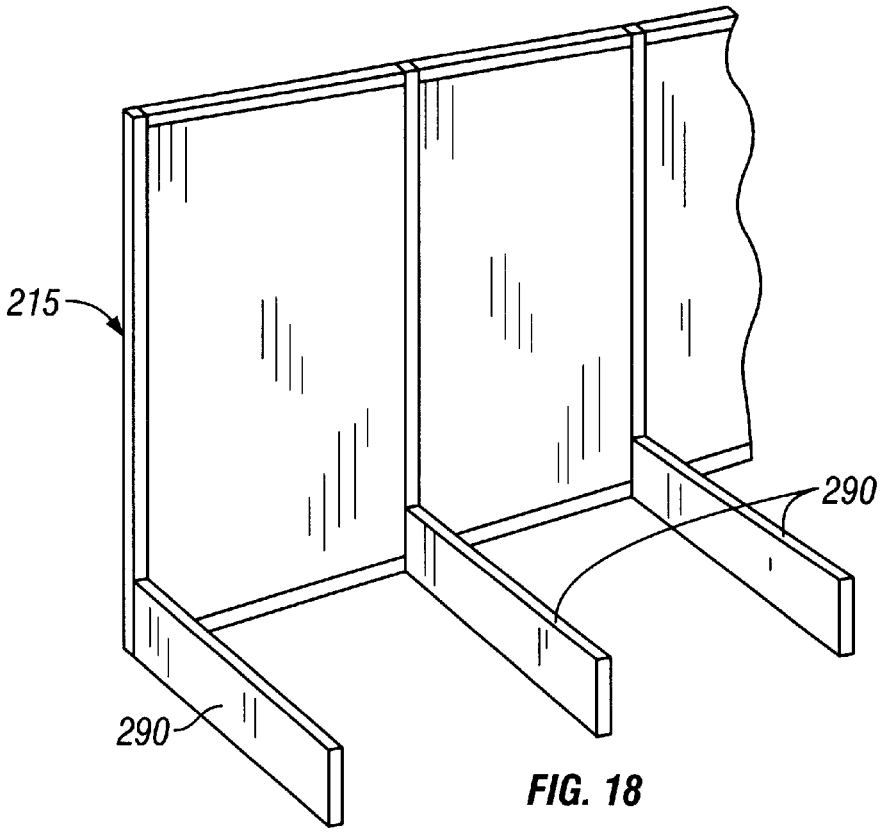
FIG. 18 is a perspective view of a typical gondola display with its base removed and its shoes exposed.
Figure 19:
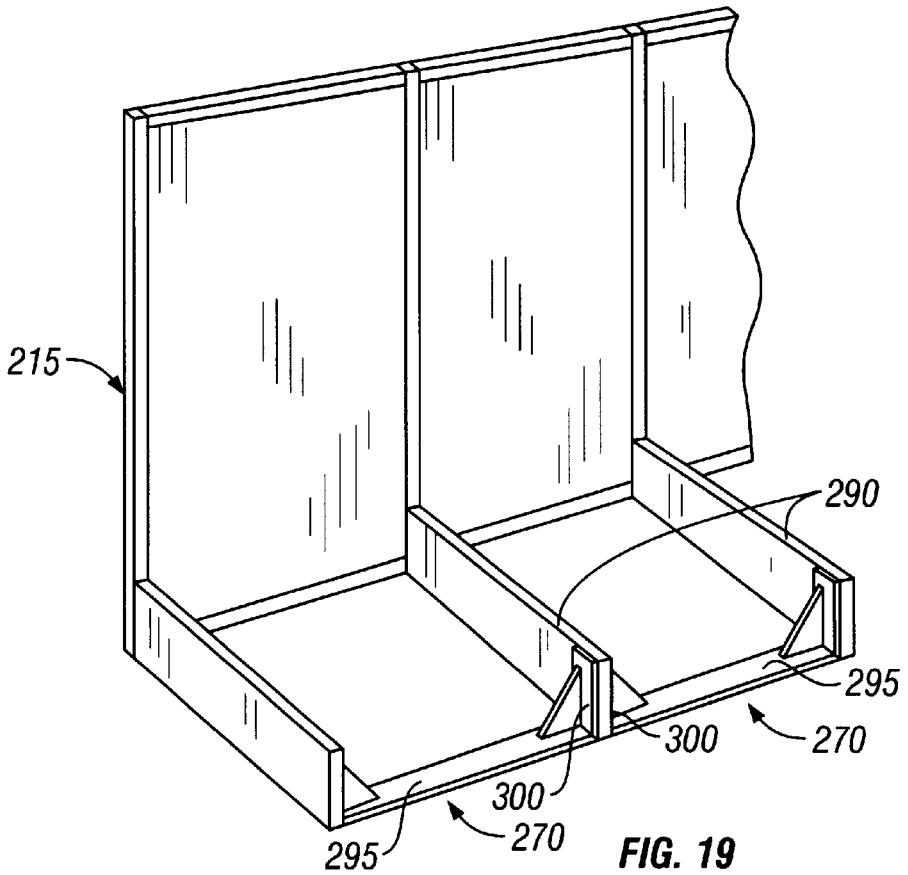
FIG. 19 is a perspective view of the gondola display of FIG. 18 with bay braces attached to the shoes thereof.
Figure 20:
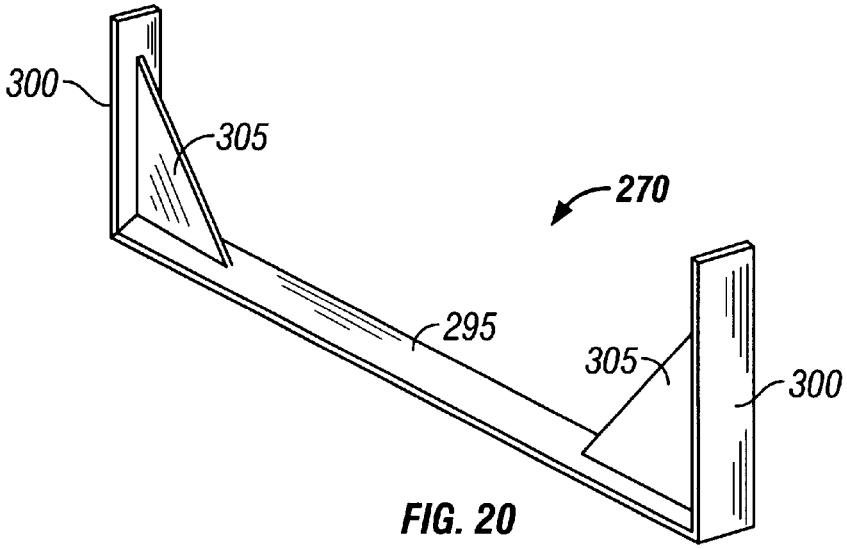
FIG. 20 is a perspective view of one of the bay braces of FIG. 19.
Figure 21:
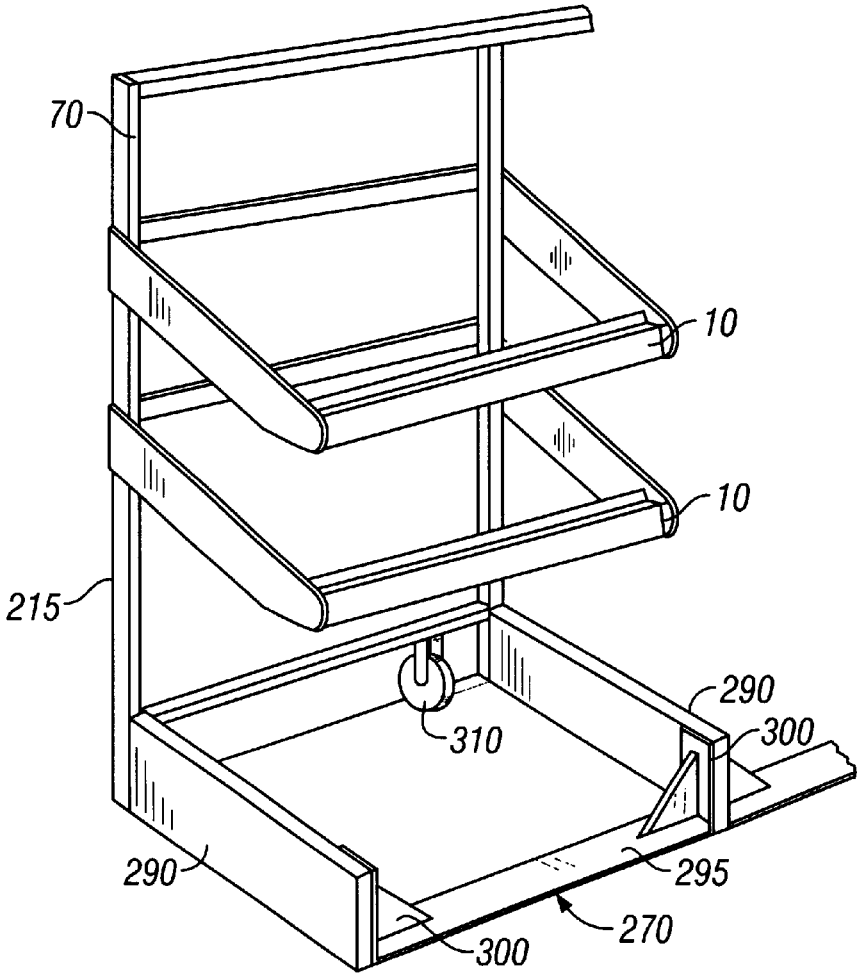
FIG. 21 is a perspective view of the gondola display of FIG. 19 with a rotating shelf unit attached thereto.

In an alternate embodiment shown in FIGS. 19–21, a preexisting gondola display 215 is adapted for use with rotating shelves 10 by replacing the gondola's existing base with a bay brace 270. As shown in FIGS. 11 and 12, conventional gondola bases typically comprise top surface 230 and front 280, which are attached to shoes 290 (see FIG. 18). In the alternative embodiment shown in FIGS. 19–21, top surface 230 and front 280 are removed to facilitate rotation of the shelves 10 into the loading position.

As shown in FIG. 18, removing top surface 230 and front 280 expose shoes 290, which are typically located approximately every 48 inches along the length of the gondola and extend approximately 24 inches from the gondola. Shoes 290 provide support for the weight of the gondola and the shelves attached thereto. To best support such weight, it is preferable that the shoes 290 remain perpendicular to the length of gondola 215.

Usually, this function is performed by top surface 230 and front 280 of the base 220. In this embodiment, however, those items have been removed to facilitate rotation of the shelves 10. Therefore, the gondola is equipped with bay brace 270 (see FIG. 20), which comprises a horizontal base 295, uprights 300 and gussets 305. Uprights 300 are attached to the ends of shoes 290 as shown in FIG. 19, such that horizontal base 295 extends between adjacent shoes 290 to keep the shoes 290 in a position perpendicular to the length of the gondola.

As in the embodiments discussed above and shown in FIG. 21, shelves 10 are equipped with one or more wheels 310 to help support the load of such shelves 10 and to facilitate rotation of such shelves. Wheels 310 can be conventional wheels or retractable wheels (as discussed above) in the extended position. In the present embodiment, horizontal base 295 is relatively flat (in the preferred embodiment, it is approximately 0.075 inches thick) in order to allow the wheel 310 to roll over base 295 and, therefore, for shelves 10 to be rotated through bay brace 270 into and out of the display position.

There has been described, with reference to specific exemplary embodiments thereof, a product display and dispensing system. It will be apparent to those skilled in the art that modifications may be made without departing from the spirit and scope of the invention. All modifications are considered within the sphere, spirit, and scope of the invention as set forth in the appended claims. The specification and drawings, therefore, are to be regarded in an illustrative rather than restrictive sense.

I claim:

1. A shelving system for use on a ground surface, the system comprising:

a support structure;

a base associated with the support structure and having a top surface;

a first shelf unit rotationally attached to the support structure such that the first shelf unit can be rotated between a display position and a loading position;

a wheel assembly associated with the first shelf unit and comprising a wheel, the wheel assembly being adjustable between a retracted position in which the wheel engages the top surface of the base when the first shelf unit is in the display position and an extended position in which the wheel engages the ground surface as the first shelf unit is rotated into the loading position.

2. The system of claim 1 wherein the first shelf unit is rotationally attached to the support structure by a hinge assembly.

3. The system of claim 1 wherein the first shelf unit can be rearloaded when rotated into the loading position.

4. The system of claim 1 wherein the support structure comprises a gondola.

5. The system of claim 3 wherein the first shelf unit comprises a frame and a shelf affixed to the frame.

6. The system of claim 4 wherein the gondola comprises a vertical support.

7. The system of claim 6 wherein the first shelf unit comprises a frame and a shelf affixed to the frame.

8. The system of claim 7 wherein the frame is rotationally attached to the vertical support by a hinge assembly.

9. The system of claim 8 wherein the frame includes a vertical standard and the hinge assembly hingedly connects the vertical standard of the frame to the vertical support of the gondola.

10. The system of claim 1 wherein the wheel assembly includes a spring mechanism and leg having a distal end and a proximal end, the proximal end of the leg is pivotally connected to the first shelf unit, the wheel is rotationally attached to the distal end of the leg and the spring mechanism biases the wheel assembly towards the wheel assembly's extended position.

11. The system of claim 9 wherein the wheel assembly includes a spring mechanism and leg having a distal end and a proximal end, the proximal end of the leg is pivotally connected to the frame, the wheel is rotationally attached to the distal end of the leg, and the spring mechanism biases the wheel assembly towards the wheel assembly's extended position.

12. The system of claim 1 further comprising a second shelf unit associated with the support structure and positioned back-to-back with the first shelf unit when the first shelf unit is in the display position.

13. The system of claim 12 wherein the support structure is open so that the second shelf unit can be rear-loaded when the first shelf unit is rotated into the loading position.

14. The system of claim 3 wherein the support structure comprises a gondola.

15. The system of claim 14 wherein the gondola comprises a vertical support.

16. The system of claim 15 wherein the first shelf unit comprises a frame and a shelf affixed to the frame.

17. The system of claim 16 wherein the frame is rotationally attached to the vertical support by a hinge assembly.

18. The system of claim 17 wherein the frame includes a vertical standard and the hinge assembly hingedly connects the vertical standard of the frame to the vertical support of the gondola.

19. The system of claim 3 wherein the wheel assembly includes a spring mechanism and leg having a distal end and a proximal end, the proximal end of the leg is pivotally connected to the first shelf unit, the wheel is rotationally attached to the distal end of the leg, and the spring mechanism biases the wheel assembly towards the wheel assembly's extended position.

20. The system of claim 19 wherein the wheel assembly includes a spring mechanism and leg having a distal end and a proximal end, the proximal end of the leg is pivotally connected to the frame, the wheel is rotationally attached to the distal end of the leg, and the spring mechanism biases the wheel assembly towards the wheel assembly's extended position.

21. The system of claim 3 further comprising a second shelf unit associated with the support structure and positioned back-to-back with the first shelf unit when the first shelf unit is in the display position.

22. The system of claim 21 wherein the support structure is open so that the second shelf unit can be rear-loaded when the first shelf unit is rotated into the loading position.

23. A display system for attachment to a support structure having a base with a top surface, the display system comprising:

a first shelf unit adapted to be rotationally attached to the support structure such that the first shelf unit can be rotated between a display position and a loading position when attached to the support system;

a wheel assembly attached to the first shelf unit and comprising a wheel, the wheel assembly being adjustable between a retracted position in which the wheel engages the top surface of the base when the shelf unit is attached to the support structure and in the display position and an extended position in which the wheel engages the ground surface as the shelf unit is rotated into the loading position.

24. The system of claim 23 wherein the first shelf unit is adapted to be rotationally attached to the support structure by a hinge assembly.

25. The system of claim 23 wherein the first shelf unit can be rearloaded when rotated into the loading position.

26. The system of claim 25 wherein the support structure comprises a gondola.

27. The system of claim 26 wherein the gondola comprises a vertical support.

28. The system of claim 27 wherein the first shelf unit comprises a frame and a shelf affixed to the frame.

29. The system of claim 28 wherein the frame is rotationally attached to the vertical support by a hinge assembly.

30. The system of claim 29 wherein the frame includes a vertical standard and the hinge assembly hingedly connects the vertical standard of the frame to the vertical support of the gondola.

31. The system of claim 23 wherein the wheel assembly includes a spring mechanism and leg having a distal end and a proximal end, the proximal end of the leg is pivotally connected to the first shelf unit, the wheel is rotationally attached to the distal end of the leg, and the spring mechanism biases the wheel assembly towards the wheel assembly's extended position.

32. The system of claim 30 wherein the wheel assembly includes a spring mechanism and leg having a distal end and a proximal end, the proximal end of the leg is pivotally connected to the frame, the wheel is rotationally attached to the distal end of the leg, and the spring mechanism biases the wheel assembly towards the wheel assembly's extended position.

33. The system of claim 23 further comprising a second shelf unit associated with the support structure and positioned back-to-back with the first shelf unit when the first shelf unit is in the display position.

34. The system of claim 33 wherein the support structure is open so that the second shelf unit can be rear-loaded when the first shelf unit is rotated into the loading position.

35. A shelving system comprising:

a support structure having a front and a back;

at least two first shelf units arranged in a row and adjacent to the front of the support structure, wherein the first shelf units are rotationally attached to the support structure such that the first shelf units can be rotated between a display position and a loading position;

at least two second shelf units arranged in a row and adjacent to the back of the support structure, wherein the second shelf units are positioned back-to-back with the first shelf units when the first shelf units are in the display position;

wherein the support structure is open so that the second shelf units can be rear-loaded when the first shelf units are rotated into the loading position.

36. The system of claim 35 wherein each of the at least two first shelf units is rotationally attached to the support structure by a hinge assembly.

37. The system of claim 35 wherein the first shelf units can be rearloaded when rotated into the loading position.

38. The system of claim 35 wherein the support structure comprises a gondola.

39. The system of claim 37 wherein each of the at least two first shelf units comprises a frame and a shelf affixed to the frame.

40. The system of claim 38 wherein the gondola comprises a vertical support.

41. The system of claim 40 wherein each of the at least two first shelf units comprises a frame and a shelf affixed to the frame.

42. The system of claim 41 wherein each of the frames is rotationally attached to the vertical support by a hinge assembly.

43. The system of claim 42 wherein each of the frames includes a vertical standard and the hinge assembly hingedly connects the vertical standard of the frame to the vertical support of the gondola.

* * * * *